US008472858B2

(12) United States Patent
Yoshida

(10) Patent No.: US 8,472,858 B2
(45) Date of Patent: Jun. 25, 2013

(54) IMAGE FORMING APPARATUS

(75) Inventor: Takeshi Yoshida, Osaka (JP)

(73) Assignee: Kyocera Mita Corporation (JP)

( * ) Notice: Subject to any disclaimer, the term of this patent is extended or adjusted under 35 U.S.C. 154(b) by 352 days.

(21) Appl. No.: 12/886,846

(22) Filed: Sep. 21, 2010

(65) Prior Publication Data

US 2011/0076078 A1 Mar. 31, 2011

(30) Foreign Application Priority Data

Sep. 25, 2009 (JP) ..... 2009-220287

(51) Int. Cl.
*G03G 15/00* (2006.01)
*B65H 29/00* (2006.01)

(52) U.S. Cl.
USPC ..... 399/401; 271/181; 271/184; 271/185

(58) Field of Classification Search
USPC ..... 399/401; 271/181, 184, 185, 301, 271/302, 303; 400/642
See application file for complete search history.

(56) References Cited

U.S. PATENT DOCUMENTS

| | | | | |
|---|---|---|---|---|
| 6,108,514 | A * | 8/2000 | Nakayama et al. | 399/400 |
| 6,618,577 | B2 * | 9/2003 | Omura | 399/401 |
| 2005/0168501 | A1 * | 8/2005 | Okuda et al. | 346/104 |
| 2008/0101830 | A1 * | 5/2008 | Sato | 399/331 |
| 2008/0240768 | A1 * | 10/2008 | Segawa et al. | 399/92 |

FOREIGN PATENT DOCUMENTS

| | | | |
|---|---|---|---|
| JP | 10181941 | A * | 7/1998 |
| JP | 3463449 | | 8/2003 |

* cited by examiner

*Primary Examiner* — Matthew G Marini
*Assistant Examiner* — Allister Primo
(74) *Attorney, Agent, or Firm* — Gerald E. Hespos; Michael J. Porco; Matthew T. Hespos

(57) ABSTRACT

A sheet discharge unit of an image forming apparatus includes a first path discharging the sheet to the outside, a second path for feeding the sheet again to the image forming unit in the case of performing a duplex image forming process, a sheet conveyor conveying the sheet from the first path to the outside, and a corrugating member corrugating the sheet in a width direction of the sheet orthogonal to a conveying direction of the sheet to give the sheet stiffness when the sheet conveyor conveys the sheet. The second path includes an upstream path section having a width that extends in a thickness direction of the sheet, the width being set to be narrow to such a degree that the corrugation of the sheet is reduced when the sheet passes the upstream path section.

7 Claims, 9 Drawing Sheets

IMAGE FORMING APPARATUS

BACKGROUND OF THE INVENTION

1. Field of the Invention

The present invention relates to an electrophotographic image forming apparatus and particularly to a sheet discharge unit for discharging a sheet having an image formed thereon to the outside of the apparatus.

2. Description of the Related Art

An image forming apparatus utilizing an electrophotographic process such as a copier, a printer, a facsimile machine or a complex machine of these includes an image forming unit for forming a toner image on a sheet by performing a predetermined image forming process, a fixing unit for heat-fixing the toner image on the sheet to the sheet, and a sheet discharge unit for discharging the heat-fixed sheet to the outside.

A sheet bearing a toner image heat-fixed thereto is easily deformed by heat and curled when being conveyed to the sheet discharge unit. Thus, the sheet discharge unit includes a corrugating member for making a sheet stiff or corrugating a sheet being discharged by a discharge roller and the like as a means for correcting a curl of the sheet. Since the creased sheet has the curl corrected, it is stacked on a discharge tray in an orderly manner.

Although sheets are prevented from being untidily stacked on the discharge tray by corrugating the sheets, sheet corrugation causes other problems in the case of forming toner images on both sides of sheets.

Specifically, the sheet discharge unit is so constructed that, when a sheet having a toner image formed on one side is fed again to the image forming unit via a predetermined path (so-called switch-back path), the sheet is conveyed to the switch-back path with a trailing end thereof with respect to a discharging direction in the lead after a part of the sheet except the trailing end with respect to the discharging direction is temporarily discharged to the outside by a discharge roller. Thus, the sheet is given stiffness or corrugated by the corrugating member. When passing a switch-back path, particularly a curved switch-back path, the corrugated sheet is conveyed to the image forming unit while being curved along a curved path in a corrugated state. This causes a conveyance trouble such as abnormal noise.

The following prior art is known as a technology for suppressing an occurrence of such a conveyance trouble. In a sheet discharge unit of the prior art, a discharge roller for discharging a sheet to the outside is used as a corrugating member, and the discharge roller is composed of a first roller including a plurality of first roller bodies arranged at predetermined intervals on a roller shaft and a second roller including a plurality of second roller bodies arranged at predetermined intervals on a roller shaft and facing the first roller bodies.

In the case of forming a toner image only on one side of a sheet, the first and second rollers are so relatively moved in an axial direction that the first roller bodies and the second roller bodies are offset from each other in the axial direction (i.e. are not in contact), thereby causing a curled sheet to pass between the first and second rollers, whereby the sheet is given stiffness while being discharged to the outside.

On the other hand, in the case of forming toner images on both sides of a sheet, the first and second rollers are so moved in the axial direction that the first and second roller bodies are opposite to and in contact with each other, thereby causing a part of the sheet except the trailing end thereof with respect to the discharging direction to pass between the first and second roller bodies opposite to and in contact with each other, whereby the sheet is conveyed to the switch-back path without being corrugated. After having toner images formed on and fixed to both sides, the sheet is corrugated while being discharged to the outside by the sheet discharge unit.

The above-described prior art can suppress an occurrence of a conveyance trouble when a sheet passes the switch-back path although a corrugating function is provided. However, the prior art requires a switching means for switching a state of the first roller bodies of the first roller and the second roller bodies of the second roller between a contact state and a non-contact state, which makes the construction more complicated. This results in not only cumbersome assembling, but also a cost increase due to an increase in the number of parts.

SUMMARY OF THE INVENTION

In view of the above situation, an object of the present invention is to provide an image forming apparatus capable of suppressing an occurrence of a conveyance trouble when a sheet passes a switch-back path while providing a corrugating function by a simple construction.

In order to accomplish the above object, one aspect of the present invention is directed to an image forming apparatus including: an image forming unit performing a predetermined image forming process to form a toner image on a sheet; a fixing unit heat-fixing the toner image on the sheet to the sheet; and a sheet discharge unit discharging the sheet finished with the heat-fixing process to the outside. The sheet discharge unit includes: a first path for discharging the sheet finished with the heat-fixing process to the outside; a second path for feeding the sheet again to the image forming unit in the case of performing a duplex image forming process for forming a toner image also on an underside of the sheet opposite to a top side where the toner image is formed; a sheet conveyor conveying the sheet from the first path to the outside, the sheet conveyor also temporarily discharging to the outside a part of the sheet except for a trailing end of the sheet with respect to a discharge direction of the sheet and then conveying the sheet back to the second path from the discharge direction trailing end; and a corrugating member corrugating the sheet in a width direction of the sheet orthogonal to a conveying direction of the sheet to give the sheet stiffness when the sheet conveyor conveys the sheet. The second path includes an upstream path section having a width that extends in a thickness direction of the sheet, the width being set to be narrow to such a degree that the corrugation of the sheet is reduced when the sheet passes the upstream path section.

DETAILED DESCRIPTION OF THE PREFERRED EMBODIMENTS

Hereinafter, one embodiment according to the present invention is described with reference to the drawings.

Figure 1:
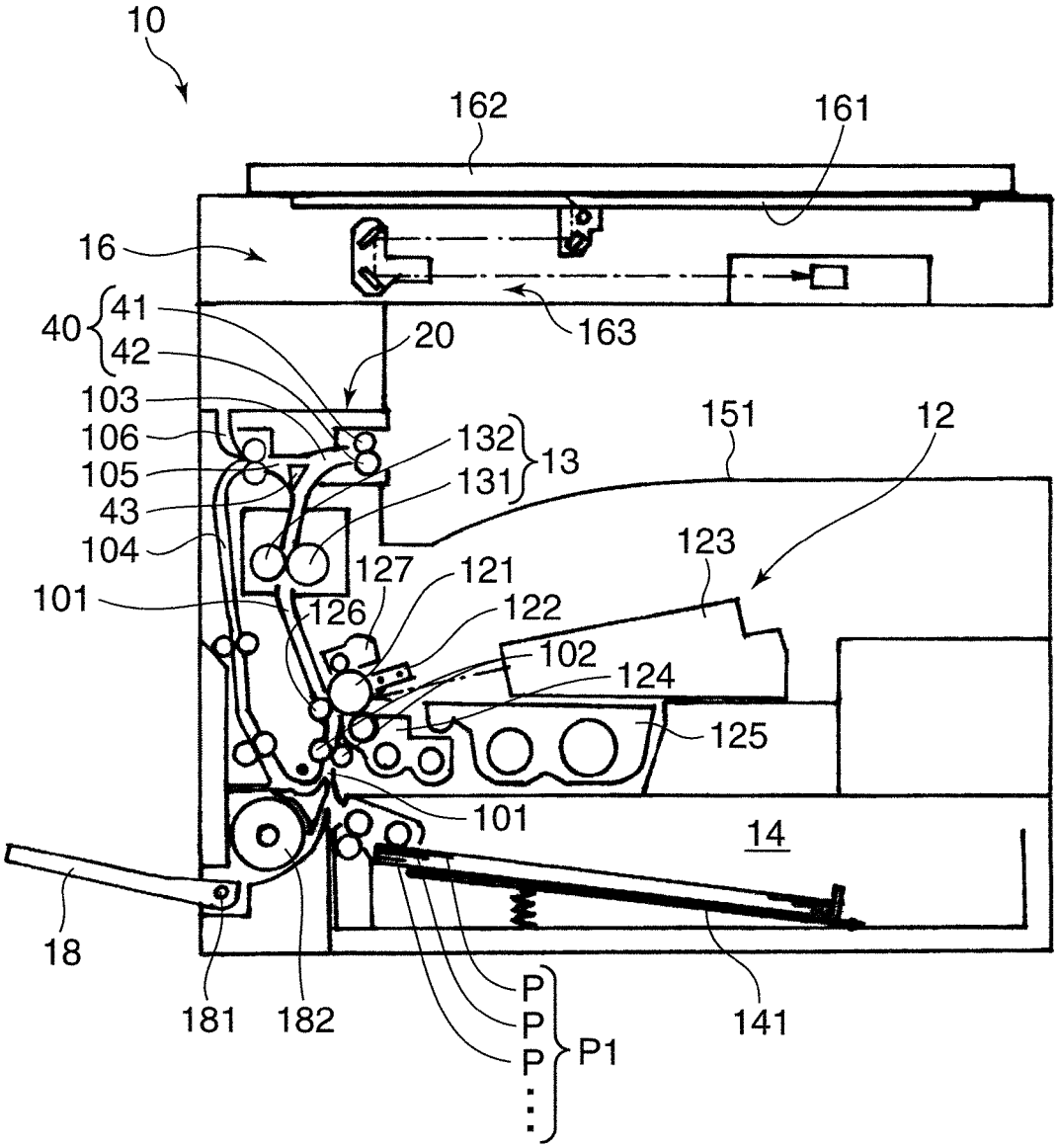
FIG. 1 is a schematic diagram showing an internal structure of an image forming apparatus according to one embodiment of the invention.

FIG. 1 is a schematic diagram showing an internal structure of an image forming apparatus according to the embodiment of the present invention. Although a copier is illustrated as the image forming apparatus, the present invention is not limited to this and is also applicable to another image forming apparatus such as a printer, a facsimile machine or a complex machine with these functions. An image forming apparatus 10 is a so-called internal discharge type copier and provided with an image forming unit 12, a fixing unit 13, a sheet storage unit 14, a sheet discharge unit 20 and an image reading unit 16.

The image reading unit 16 includes a contact glass 161 on which a document is to be placed, an openable and closable document pressing cover 162 for pressing a document placed on the contact glass 161 and a scanning mechanism 163 for scanning an image of a document placed on the contact glass 161. After being converted into a digital signal, analog information of a document image read by the scanning mechanism 163 is output to an exposure device 123 to be described later and used for an image forming process in the image forming unit 12.

The image forming unit 12 includes a photosensitive drum 121, a charger 122 for uniformly charging the circumferential surface of the photosensitive drum 121, the exposure device 123 for forming an electrostatic latent image on the circumferential surface of the photosensitive drum 121 by a laser beam based on image information of a document image read by the image reading unit 16, and a developing device 124 for forming a toner image on the circumferential surface of the photosensitive drum 121 by supplying toner to an electrostatic latent image.

A transfer roller 126 arranged to face the photosensitive drum 121 is disposed lateral to (to the left in FIG. 1) the photosensitive drum 121, and a nip portion is formed between the circumferential surface of the photosensitive drum 121 and the transfer roller 126.

The developing device 124 receives the supply of toner from a toner container 125. The toner container 125 is replaced with a new one when the toner is used up.

The sheet storage unit 14 includes a detachably insertable sheet cassette 141. A sheet stack P1 is stored in the sheet cassette 141. In performing an image forming process, sheets P are dispensed one by one from the sheet stack P1 and fed to the image forming unit 12 to have the image forming process performed thereon.

A manual feed tray 18 rotatable about a supporting shaft 181 is provided on a side surface (left surface in FIG. 1) of the image forming apparatus 10. Sheets placed on the manual feed tray 18 are fed one by one to a sheet conveyance path 101 by a feed roller 182.

A sheet P fed from the sheet cassette 141 passes the sheet conveyance path 101 and is conveyed to a nip portion between the photosensitive drum 121 and the transfer roller 126 by a registration roller pair 102. The sheet P conveyed to the nip portion has a toner image on the circumferential surface of the photosensitive drum 121 transferred thereto. The sheet P having the toner image transferred thereto is fed to the fixing unit 13.

The circumferential surface of the photosensitive drum 121 is cleaned by a cleaner 127 after the toner image is transferred to the sheet P, and charged again by the charger 122 for a new image forming process.

The fixing unit 13 includes a fixing roller 131 internally provided with an electric heating element such as a halogen lamp, and a pressure roller 132 arranged to face the fixing roller 131. The sheet P having the toner image transferred thereto receives heat from the fixing roller 131 upon passing a nip portion between the fixing roller 131 and the pressure roller 132. Thus, the toner image is heated and fixed to the sheet P.

The sheet P finished with the fixing process is discharged from the fixing unit 13 and conveyed to the sheet discharge unit 20. The sheet discharge unit 20 includes a first branching guide member 43. The first branching guide member 43 switches a discharge path for the sheet P between a first sheet discharge path (first path) 103 and a second sheet discharge path 105 (third path). If the sheet discharge path is switched to the first sheet discharge path 103 by the first branching guide member 43, the sheet P is discharged onto a discharge tray 151. On the other hand, if the sheet discharge path is switched to the second sheet discharge path 105 by the first branching guide member 43, the sheet P is conveyed to an unillustrated post-processing apparatus arranged lateral to the image forming apparatus 10 through the second sheet discharge path 105. Stapling, for example, is applied to the sheet P conveyed to the post-processing apparatus.

In the case of a duplex image forming process for forming a toner image also on an underside of a sheet P after forming a toner image on a top side (one side) of the sheet P, the sheet discharge unit 20 guides the sheet P to a switch-back path (second path) 104. The sheet P is conveyed to the nip portion between the photosensitive drum 121 and the transfer roller 126 via the switch-back path 104 to have a toner image transferred also to the underside thereof. The sheet P having the toner image also formed on the underside thereof is subjected to a heat-fixing process in the fixing unit 13. The sheet P discharged from the fixing unit 13 is discharged onto the discharge tray 151 through the first sheet discharge path 103 or conveyed to the post-processing apparatus through the second sheet discharge path 105 by the first branching guide member 43 of the sheet discharge unit 20.

Figure 2:
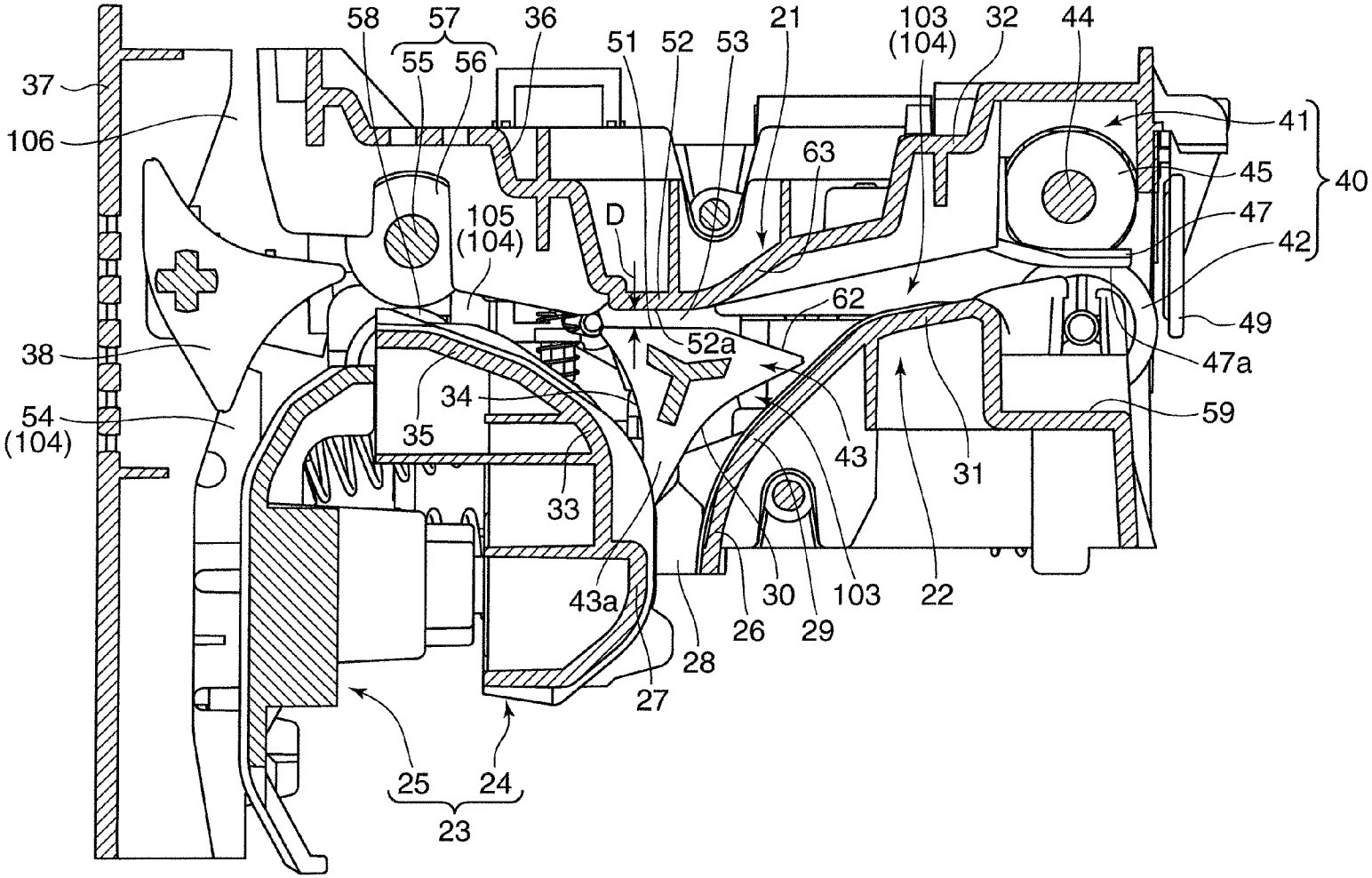
FIG. 2 is a diagram showing an internal structure of a sheet discharge unit when viewed in a longitudinal direction.
Figure 3:
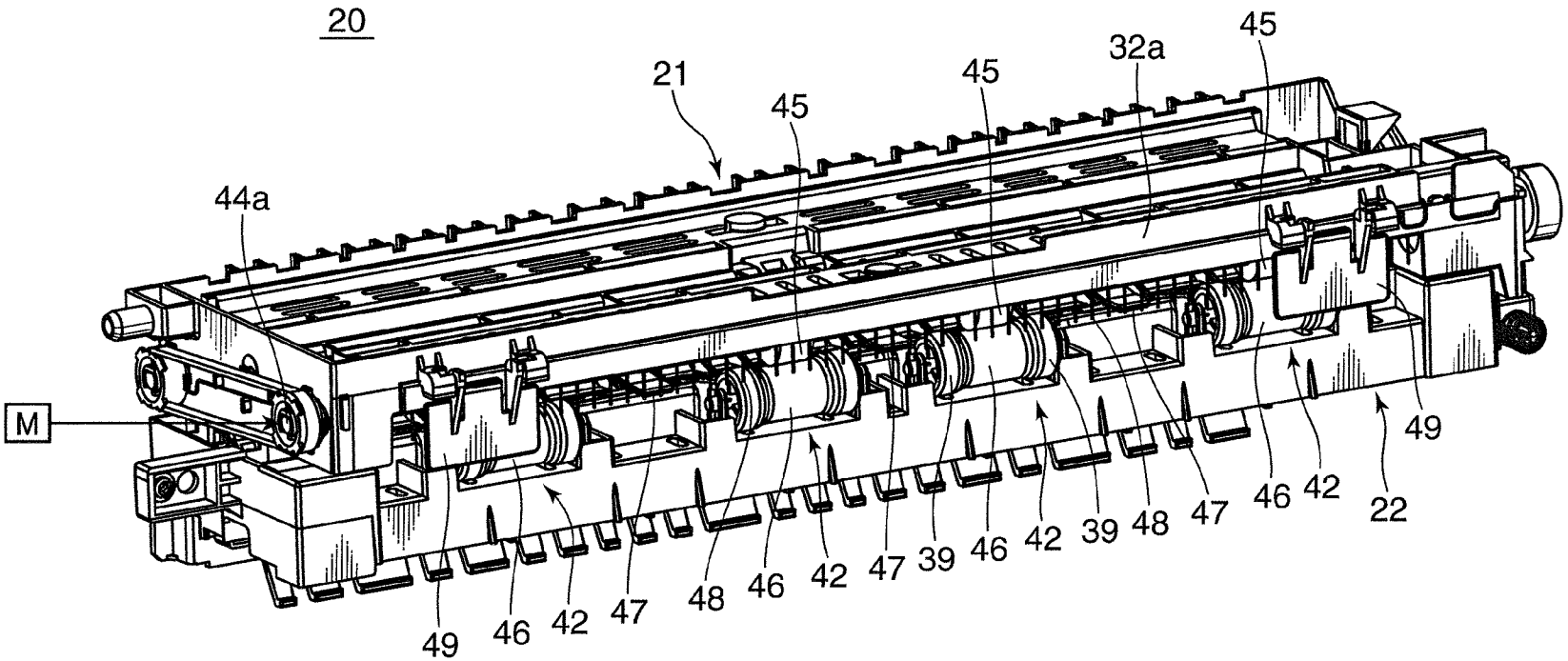
FIG. 3 is an external perspective view of the sheet discharge unit.

The construction of the sheet discharge unit 20 is described below with reference to FIGS. 2 and 3. FIG. 2 is a diagram showing an internal structure of the sheet discharge unit 20 when viewed in a longitudinal direction and FIG. 3 is an external perspective view of the sheet discharge unit 20.

The sheet discharge unit 20 includes a housing having an upper frame 21 and a first lower frame 22 and a second lower frame 23 arranged below the upper frame 21, wherein an inner space of the sheet discharge unit 20 is defined by the upper frame 21 and the first and second lower frames 22, 23. The upper frame 21 and the first and second lower frames 22, 23 are frame members extending in the longitudinal direction of the sheet discharge unit 20 (i.e. width direction of sheets P to be discharged). The first and second lower frames 22, 23 are facing each other along the longitudinal direction. The second lower frame 23 has a first frame half body 24 and a second frame half body 25 divided along the longitudinal direction.

An entrance port 28 for sheets P is formed between a bottom end portion 26 of the first lower frame 22 and a bottom end portion 27 of the first frame half body 24, and the sheet P discharged from the fixing unit 13 enters the sheet discharge unit 20 through the entrance port 28.

The first sheet discharge path 103 extending obliquely upward to the right in FIG. 2 when viewed from the entrance port 28 is defined between the upper frame 21 and the first lower frame 22 in the inner space of the sheet discharge unit 20. Further, the second sheet discharge path 105 extending obliquely upward to the left in FIG. 2 when viewed from the entrance port 28 is defined between the upper frame 21 and the second lower frame 23 in the inner space of the sheet discharge unit 20. The first branching guide member 43 for guiding the sheet P to either one of the first and second sheet discharge paths 103, 105 is arranged substantially above the entrance port 28 in the inner space.

The first sheet discharge path 103 is specifically formed as below. Namely, the first lower frame 22 includes a curved portion 29 extending in a curved manner obliquely upward to the right in FIG. 2 from the bottom end portion 26, and the first branching guide member 43 includes a first curved portion 30 extending along the curved portion 29 of the first lower frame 22 while facing the curved portion 29. The first sheet discharge path 103 is defined by a space formed between the curved portion 29 of the first lower frame 22 and the first curved portion 30 of the first branching guide member 43 and a space formed between a downstream part 31 of the curved portion 29 of the first lower frame 22 downstream of the first branching guide member 43 with respect to a discharging direction of a sheet P passing the first sheet discharge path 103 and a right end portion 32 of the upper frame 21 in FIG. 2.

The second sheet discharge path 105 is specifically formed as follows. Namely, the first frame half body 24 includes a curved portion 33 extending in a curved manner obliquely upward to the left in FIG. 2 from the bottom end portion 27, and the first branching guide member 43 includes a second curved portion 34 extending along the curved portion 33 of the first frame half body 24 while facing the curved portion 33. The second curved portion 34 is a surface facing in a direction opposite to the first curved portion 30. The second sheet discharge path 105 is defined by a space formed between the curved portion 33 of the first frame half body 24 and the second curved portion 34 of the first branching guide member 43 and a space formed between a downstream part 35 of the curved portion 33 of the first frame half body 24 downstream of the first branching guide member 43 with respect to a discharging direction of a sheet P passing the second sheet discharge path 105 and a left end portion 36 of the upper frame 21 in FIG. 2.

The second sheet discharge path 105 communicates with an outside-unit discharge path 106. The outside-unit discharge path 106 is formed between the left end portion 36 of the upper frame 21 and an outer wall 37 defining an inner space of the image forming apparatus 10 and located to the left of the left end portion 36 in FIG. 2. The outside-unit discharge path 106 is a path for guiding a sheet P to the post-processing apparatus. A second branching guide member 38 is arranged in a communicating part between the second sheet discharge path 105 and the outside-unit discharge path 106. The second branching guide member 38 is for guiding a sheet P from the second sheet discharge path 105 to the outside-unit discharge path 106 and guiding a sheet P, which is switched back as will be described later after passing the first sheet discharge path 103, to the switch-back path 104.

The first branching guide member 43 includes a projecting portion 43*a* extending toward the entrance port 28, and the projecting portion 43*a* is laterally pivotable in FIG. 2. When the projecting portion 43*a* pivots to the left (first direction) to come into contact with the curved portion 33 of the first frame half body 24 as shown in FIG. 2, the second sheet discharge path 105 is closed by the projecting portion 43*a* and the first sheet discharge path 103 is opened. On the other hand, when the projecting portion 43*a* conversely pivots to the right (second direction) to come into contact with the curved portion 29 of the first lower frame 22, the first sheet discharge path 103 is closed by the projecting portion 43*a* and the second sheet discharge path 105 is opened. In this way, a sheet P from the fixing unit 13 is selectively guided to either one of the first and second sheet discharge paths 103, 105 as described above.

The sheet P guided to the first sheet discharge path 103 by the first branching guide member 43 is discharged onto the discharge tray 151 through a sheet discharge port 59. The sheet discharge port 59 is a space defined between the right end portion 32 of the upper frame 21 and the downstream part 31 of the first lower frame 22, and this space is so shaped as to accommodate a sheet conveyor 40 capable of conveying sheets P onto the discharge tray 151.

The sheet conveyor 40 includes a discharge roller 41 and discharge rolls 42 vertically facing each other in FIG. 2. The discharge roller 41 has a plurality of roller bodies 45 are arranged at predetermined intervals in an axial direction of a rotary shaft (FIG. 5) 44. The discharge rolls 42 are arranged opposite to and in contact with the corresponding roller bodies 45. In this embodiment, four roller bodies 45 and four discharge rolls 42 are used.

The rotary shaft 44 is rotatably supported at opposite longitudinal ends of the upper frame 21 and rotated by a motor M connected to a shaft end portion 44*a* of the rotary shaft 44. As the rotary shaft 44 rotates, the roller bodies 45 rotate. The motor M can rotate the roller bodies 45 in both forward and reverse directions via the rotary shaft 44.

A part of each discharge roll 42 held in contact with the corresponding roller body 45 is in the form of a circumferentially extending groove portion 46. In other words, both end parts of each discharge roll 42 are formed into projecting portions 39 extending in a circumferential direction. Accordingly, the roller bodies 45 corresponding to the respective discharge rolls 42 rotate while being held in contact with the groove portions 46 between the projecting portions 39 of the discharge rolls 42. The discharge rolls 42 are rotated as the roller bodies 45 rotate.

Further, first corrugating pieces 47 for corrugating a sheet P or making a sheet P stiff are arranged between pairs of adjacent roller bodies 45 and discharge rolls 42. The first corrugating pieces 47 have corrugating surfaces 47*a* located substantially on the same plane where the roller bodies 45 of the discharge roller 41 and the discharge rolls 42 are in contact.

A plurality of discharging brush 48 hanging down from the right end portion 32 of the upper frame 21 are arranged downstream of the roller bodies 45 and the first corrugating pieces 47 with respect to the sheet discharging direction in the sheet discharge port 59. The discharging brush 48 are made of electrically conductive metal fibers and arranged at predetermined intervals in the longitudinal direction of the sheet discharge unit 20.

Second corrugating pieces 49 are arranged on an end surface 32*a* of the right end portion 32 of the upper frame 21 and downstream of the discharging brush 48 with respect to the sheet discharging direction. The second corrugating pieces 49 are respectively arranged at the opposite longitudinal ends of the end surface 32*a*. The respective second corrugating pieces 49 are so shaped as to extend to a position below the plane where the roller bodies 45 of the discharge roller 41 and the discharge rolls 42 are in contact. Further, the respective corrugating pieces 49 can vertically flap.

Figure 4:
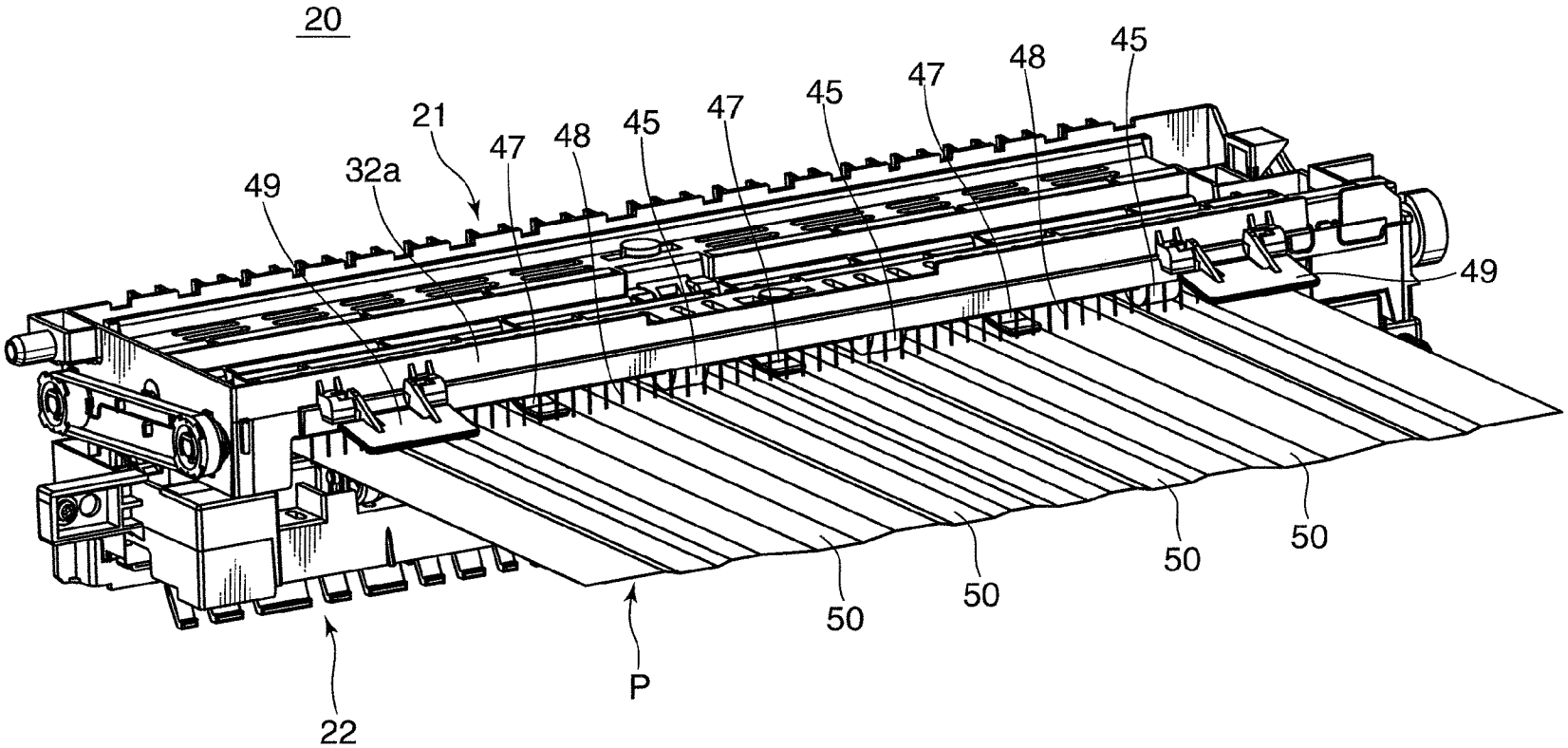
FIG. 4 is an external perspective view of the sheet discharge unit showing a state where a sheet is corrugated by the sheet discharge unit.

The sheet conveyor 40 constructed as above discharges a sheet P, having passed along the first sheet discharge path 103, onto the discharge tray 151 while corrugating the sheet P. Specifically, the sheet P is discharged onto the discharge tray 151 while being held between the roller bodies 45 of the discharge roller 41 and the groove portions 46 of the corresponding discharge rolls 42 and being pressed against the corrugating surfaces 47*a* of the first corrugating pieces 47. After passing between the discharge roller 41 and the discharge rolls 42, the sheet P comes into contact with the second corrugating pieces 49 and is discharged onto the discharge tray 151 while pushing the second corrugating pieces 49 upward. A plurality of lines 50 extending in the sheet discharging direction are formed side by side in a width direction of the sheet P as shown in FIG. 4. Thus, the sheet P is deformed in a wavy manner in the sheet width direction, thereby being in a so-called stiffened or corrugated state.

Sheets P are easily deformed by heat upon being subjected to the heat-fixing process in the fixing unit 13, curled while being conveyed in the first sheet discharge path 103 through the entrance port 28, and stacked on the discharge tray 151 in an untidy manner if being discharged onto the discharge tray 151 in a curled state. However, by corrugating the sheets P or making the sheets P stiff as described above, curls of the sheets P are corrected, wherefore the sheets P can be stacked on the discharge tray 151 in an orderly manner.

As described above, the sheet conveyor 40 is so constructed as to be able to discharge a sheet P onto the discharge tray 151 while corrugating the sheet P and to convey a sheet P to the switch-back path 104 in the case of a duplex image forming process for forming a toner image also on the underside of the sheet P after a toner image is formed on the top side of the sheet P. Conveyance of a sheet P to the switch-back path 104 by the sheet conveyor 40 is described below while referring to FIG. 2 again.

As shown in FIG. 2, the first branching guide member 43 includes an upper surface 51 located at a side opposite to the projecting portion 43*a* and connecting the upper edge of the first curved portion 30 and that of the second curved portion 34, and a space 53 is formed between the upper surface 51 and a part 52 of the upper frame 21 facing the upper surface 51. This space 53 communicates with a space formed between a downstream part of the first sheet discharge path 103, i.e. the downstream part 31 of the curved portion 29 of the first lower frame 22 downstream of the first branching guide member 43, and the right end portion 32 of the upper frame 21 in FIG. 2. This space 53 also communicates with a space formed between a downstream part of the second sheet discharge path 105, i.e. the downstream part 35 of the curved portion 33 of the first frame half body 24 downstream of the first branching guide member 43, and the left end portion 36 of the upper frame 21. Note that the upper surface 51 of the first branching guide member 43 and the first and second curved portions 30, 34 extend in the longitudinal direction of the sheet discharge unit 20.

The sheet conveyor 40 temporarily discharges a part of a sheet P having passed along the first sheet discharge path 103 except a trailing end thereof with respect to the discharging direction to the outside while holding the trailing end between the discharge roller 41 and the discharge rolls 42 by rotating the rotary shaft 44 of the discharge roller 41 in the forward direction in the case of the duplex image forming process for forming a toner image also on the underside of the sheet P. Thereafter, the sheet conveyor 40 rotates the rotary shaft 44 in the reverse direction. In this way, the sheet P is conveyed backward successively through the downstream part of the first sheet discharge path 103, the space 53 between the upper frame 21 and the first branching guide member 43, the downstream part of the second sheet discharge path 105 and the space 54 formed between the second frame half body 25 and the outer wall 37 of the image forming apparatus 10, thereby being fed to the image forming unit 12 again. In other words, the switch-back path 104 is a path through the downstream part of the first sheet discharge path 103, the space 53, the downstream part of the second sheet discharge path 105 and the space 54.

A conveyor roller pair is arranged in the downstream part of the second sheet discharge path 105. The conveyor roller pair is composed of a conveyor roller 57 including a plurality of roller bodies 56 arranged at predetermined intervals in an axial direction of a rotary shaft 55, and conveyor rolls 58 arranged opposite to and in contact with the corresponding roller bodies 56. A sheet P passing the second sheet discharge path 105 or the switch-back path 104 is conveyed further downstream in the path 105 or 104 by the conveyor roller pair.

The sheet P having fed to the image forming unit 12 again via the switch-back path 104 has a toner image also formed on the underside thereof and is discharged onto the discharge tray 151 while being corrugated by the sheet conveyor 40 in the sheet discharge unit 20 as described above after being subjected to the heat-fixing process in the fixing unit 13.

Since a part of the switch-back path 104 constructed as described above downstream of the conveyor roller pair is a curved path (i.e. space 54) having a curved shape, a conveyance trouble such as abnormal noise occurs in the curved path 54 when the corrugated sheet P passes the curved path 54. In other words, since the sheet P is formed with the lines 50 extending in the sheet conveying direction to become wavy, it is difficult to curve this sheet P along the curved path 54. Abnormal noise is generated when such a sheet P is forcibly conveyed in the curved path 54.

Accordingly, in the sheet discharge unit 20 of this embodiment, a measure is taken to suppress the conveyance trouble of sheets P. This means is described below with reference to FIGS. 2 and 5.

In this embodiment, the space 53 between the upper surface 51 of the first branching guide member 43 and a facing part 52 of the upper frame 21 facing the upper surface 51 serves as an upstream path section of the switch-back path 104. In other words, the upstream path section 53 is defined by the upper surface 51 of the first branching guide member 43 and the facing part (wall portion) 52 of the upper frame 21. In this embodiment, the first branching guide member 43 constitutes a facing member facing the facing part 52.

Figure 5:
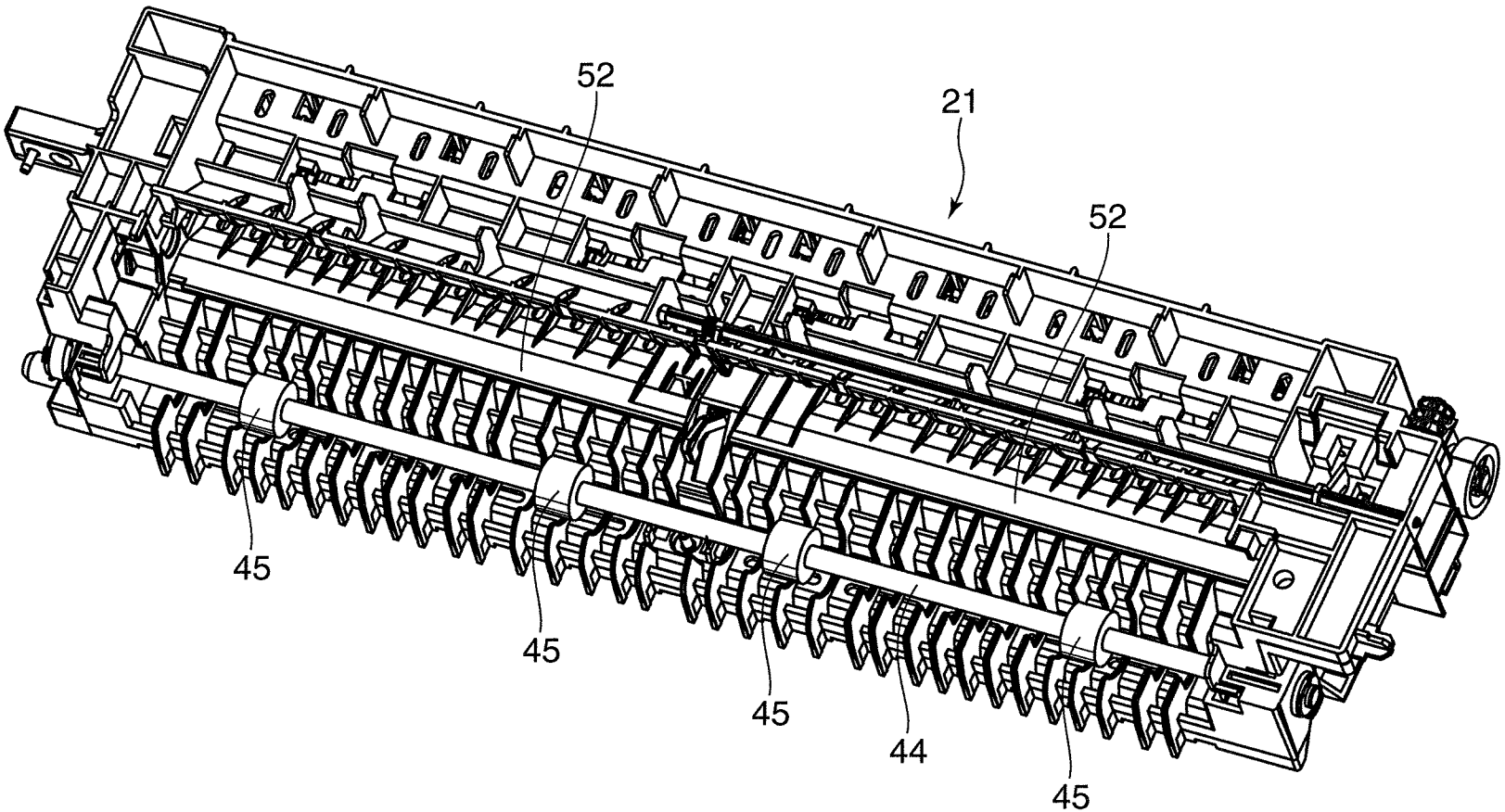
FIG. 5 is a perspective view of an upper frame of the sheet discharge unit when viewed from below.
Figure 8:
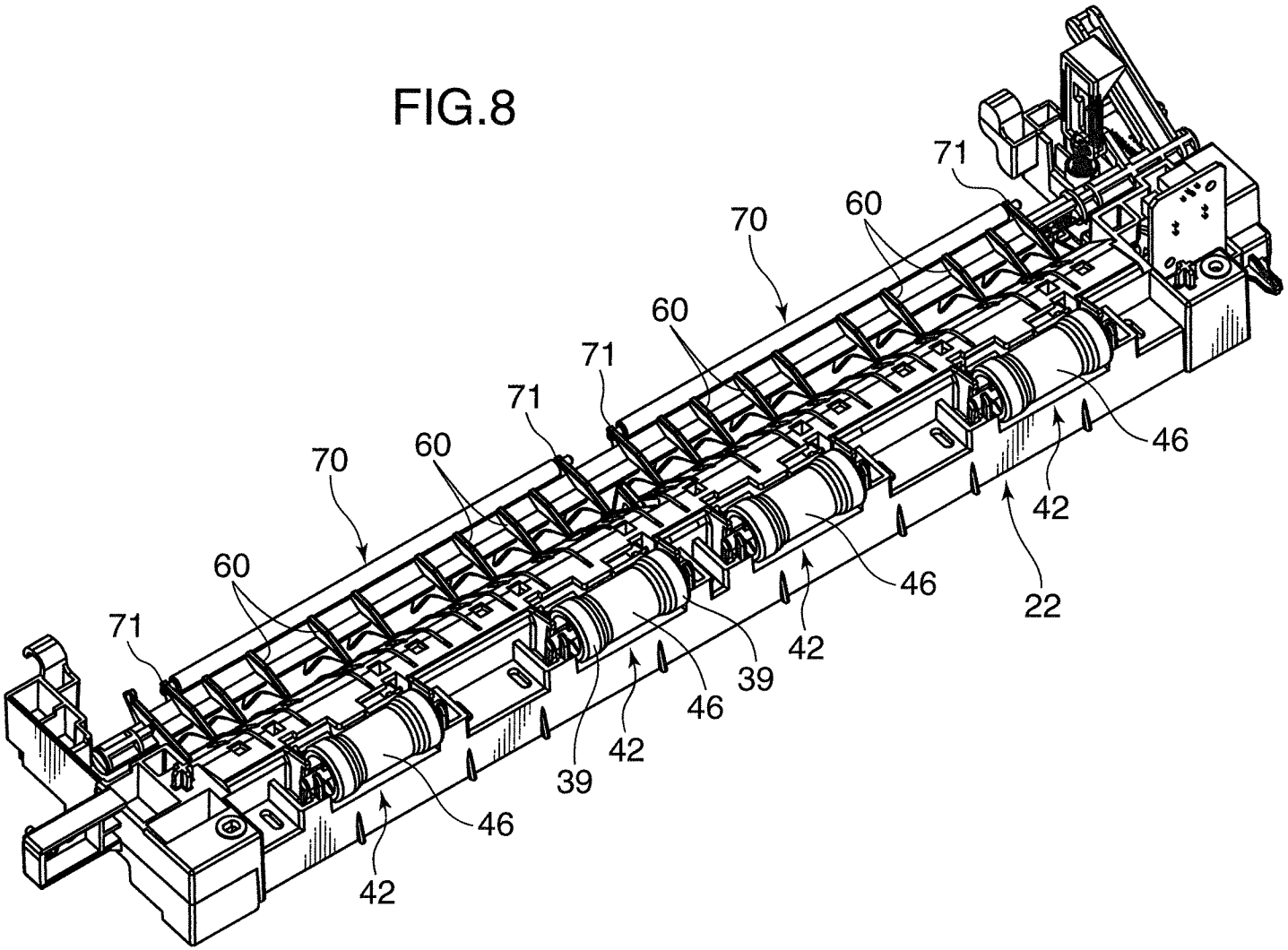
FIG. 8 is a perspective view showing the internal construction of the sheet discharge unit showing a state where roller members are mounted on the first branching guide member.

The facing part 52 of the upper frame 21 is formed as a flat part extending along the upstream path section 53 as shown in FIG. 5. The flat part 52 includes a flat surface 52*a* facing the upper surface 51. The flat part 52 is a part with which the underside (surface where no toner image is formed yet) of a sheet P comes into contact, and the upper surface 51 of the first branching guide member 43 is a surface with which the top surface of the sheet P where a toner image is formed comes into contact. Above the first branching guide member 43, a plurality of ribs 60 are formed at predetermined intervals in the longitudinal direction of the sheet discharge unit 20 as shown in FIG. 8. In this embodiment, the upper surface 51 is formed by the upper surfaces of the respective plurality of ribs 60. Note that the upper surfaces of the plurality of ribs 60 may be connected to form a flat part.

The upstream path section 53 has a width D extending in a thickness direction of a sheet P, and the width D is set to be narrow to such a degree that the lines 50 making the sheet P wavy can be straightened when the sheet P passes the upstream path section 53. Specifically, a clearance D between the flat part 52 and the upper surface 51 forms a narrowed space for correcting the sheet P, having the lines 50 and wavily deformed, into a flat state. The width (clearance) D can be easily set by appropriately setting relative positions, shapes and dimensions of the upper frame 21 and the first branching guide member 43. For example, the width D can be narrowed by appropriately setting the position and dimensions of the first branching guide member 43 to such a degree as not to affect the switch between the first sheet discharge path 103 and the second sheet discharge path 105.

The first branching guide member 43 includes an inclined surface 62 extending obliquely downward to the right in FIG. 2 from the upper surface 51 toward the curved portion 29 of the first lower frame 22. Further, an upstream part 63 of the upper frame 21 upstream of the flat part 52 when viewed from the switch-back path 104 serves as an inclined portion extending obliquely upward to the right in FIG. 2. Thus, a space between the inclined surface 62 of the first branching guide member 43 and the inclined portion 63 of the upper frame 21 is narrowed toward the upstream path section 53. Therefore, the sheet P formed with the lines 50 to become wavy can be smoothly guided to the upstream path section 53.

A surface treatment may be applied to the flat part 52 to improve slidability between the upstream path section 53 and the sheet P. The surface treatment is performed, for example, by coating the flat part 52 with a fluororesin or the like. By coating, sheets P are smoothly conveyed.

When passing the upstream path section 53 having the width (clearance) D set as described above, a sheet P is held between the flat part 52 and the upper surface 51 with the top side thereof held in sliding contact with the flat part 52 and the underside thereof held in sliding contact with the upper surface 51. By holding the sheet P in sliding contact with the upstream path section 53 in this way, the lines 50 making the sheet P wavy are forcibly pressed in the thickness direction of the sheet P. Thus, the lines 50 making the sheet P wavy are straightened. As a result, even if the sheet P passes the curved path 54, an occurrence of the conveyance trouble of the sheet P, e.g. generation of abnormal noise, is suppressed. As described above, the sheet discharge unit 20 according to this embodiment suppresses the conveyance trouble of sheets P by a simple construction of narrowing the upstream path section 53 of the switch-back path 104 in the thickness direction of the sheets P.

Since the sheet P is caused to pass the upstream path section 53 while being held in sliding contact with the part (flat part 52) set to be flat, the wavy shape of the sheet P can be straightened substantially over the entire plane of the sheet P. Further, since the flat part 52 as apart of the upstream path section 53 is formed utilizing the upper frame 21 constituting a part of the housing, a cost reduction can be realized.

Further, since the first branching guide member 43 is used as the facing member for narrowing the width D by facing the flat part 52, the number of parts can be reduced as compared with the case where the first branching guide member 43 and the facing member are separate members.

Figure 6:
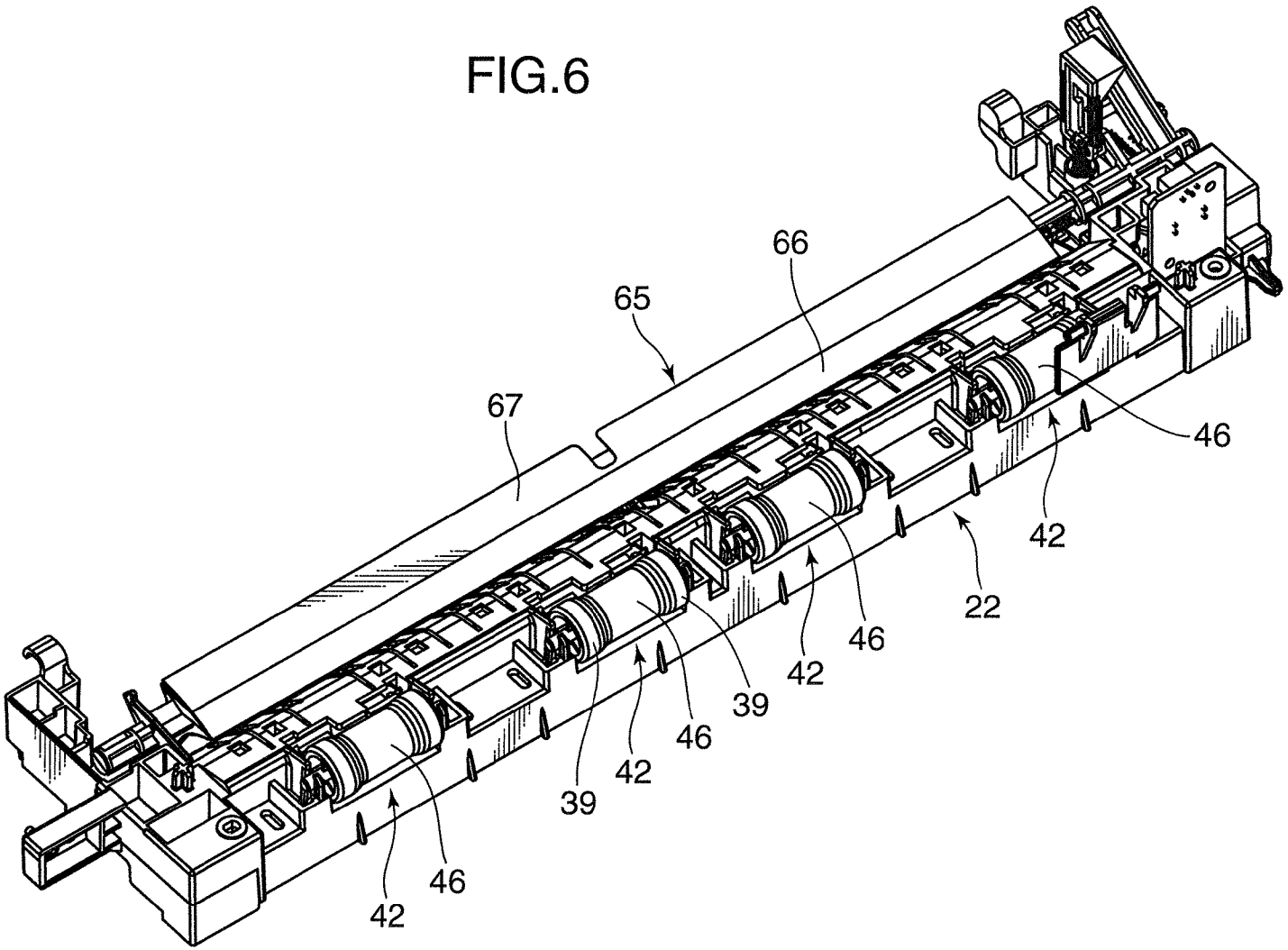
FIG. 6 is a perspective view showing an internal construction of the sheet discharge unit showing a state where an elastic sheet member is attached to a first branching guide member.
Figure 7:
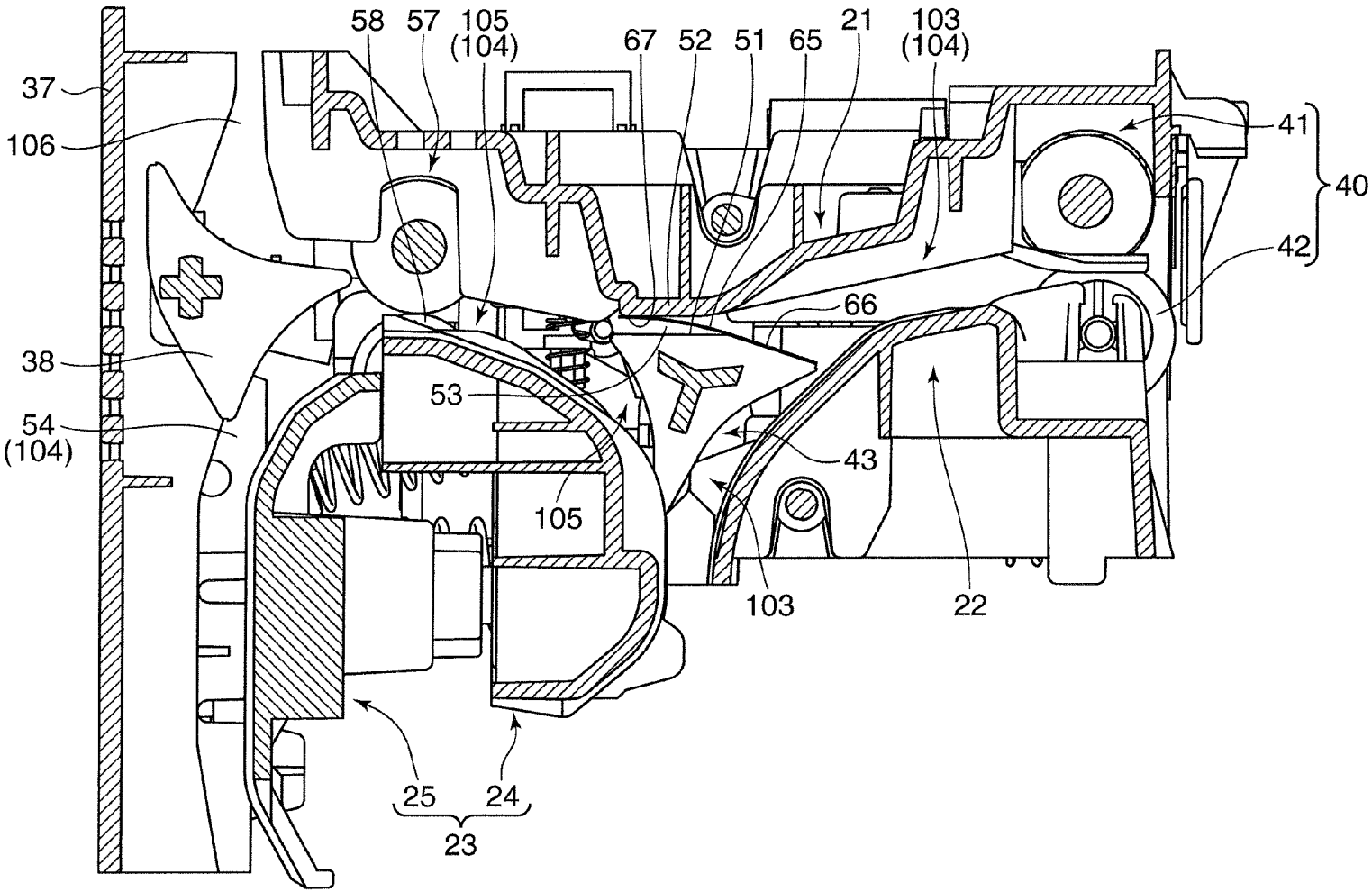
FIG. 7 is a diagram showing the internal structure of the sheet discharge unit when viewed in the longitudinal direction showing the state where the elastic sheet member is attached to the first branching guide member.

A means for straightening the sheet P more is employed in the sheet discharge unit 20 according to this embodiment. FIGS. 6 and 7 show an elastic sheet member 65 as an example of this means. The elastic sheet member 65 is a sheet member extending in the longitudinal direction of the sheet discharge unit 20 and includes a base end portion 66 and a leading end portion 67. The base end portion 66 is located at an upstream side with respect to the conveying direction of a sheet P being conveyed to the image forming unit 12 through the switch-back path 104, and attached to the inclined surface 62 of the first branching guide member 43. The leading end portion 67 extends from the base end portion 66 toward a downstream side with respect to the conveying direction and is so elastic as to be held in contact with the flat part 52.

The sheet P enters between the leading end portion 67 of the elastic sheet member 65 and the flat part 52 upon passing the upstream path section 53 and is biased toward the flat part 52 by the leading end portion 67, whereby the underside thereof comes into sliding contact with the flat part 52. In this way, the corrugation of the sheet P is further reduced.

Figure 9:
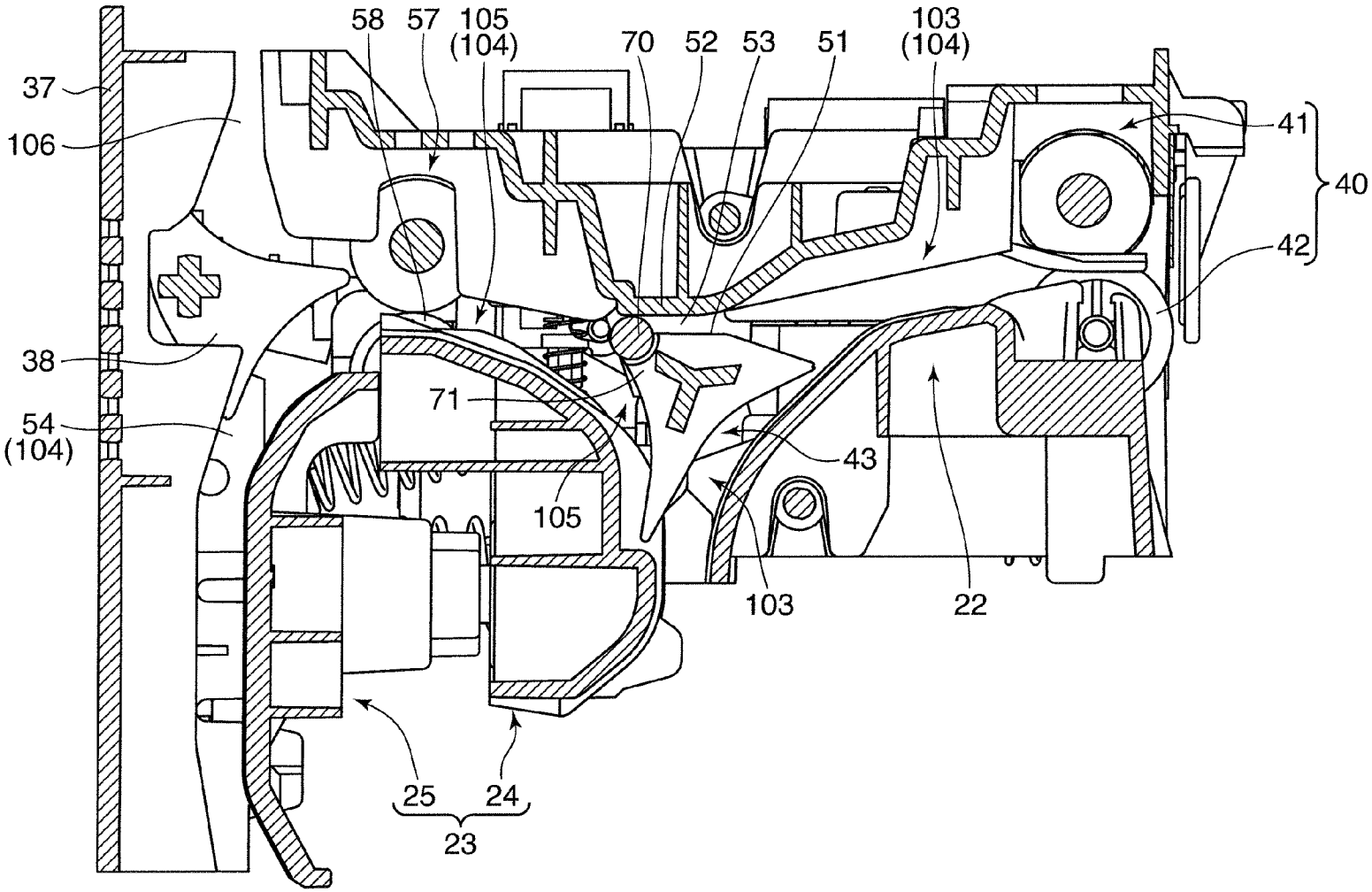
FIG. 9 is a diagram showing the internal structure of the sheet discharge unit when viewed in the longitudinal direction showing the state where the roller members are mounted on the first branching guide member.

FIGS. 8 and 9 show roller members 70 as another example of the above means. Each roller member 70 extends in the longitudinal direction of the sheet discharge unit 20 (width direction of a sheet P) and two roller members 70 are used in the example shown in FIGS. 8 and 9. The respective roller members 70 are rotatably arranged at a downstream end portion 71 of the upper surface 51 of the first branching guide member 43 with respect to the discharging direction of the sheet P, i.e. between downstream end portions 71 of specified ones of the plurality of ribs 60. One and the other roller members 70 are coaxially aligned in the longitudinal direction. The circumferential surfaces of the respective roller members 70 are in contact with the flat part 52. The roller members 70 are driven and rotated as the sheet P enters between the roller members 70 and the flat part 52.

Since the sheet P is held between the circumferential surfaces of the roller members 70 and the flat part 52 upon passing the upstream path section 53, the top side thereof is held in sliding contact with the circumferential surfaces of the roller members 70 while the underside thereof is held in sliding contact with the flat part 52. Therefore, the corrugation of the sheet P is further reduced.

As described above, the elastic sheet member 65 and the roller members 70 shown in FIGS. 6 to 9 promote sheet straightening or corrugation reduction by actively pressing the sheet P against the flat part 52.

In the embodiment described above, the top side of a sheet P where a toner image is formed is held in sliding contact with the upper surface 51 of the first branching guide member 43 and the underside thereof is held in sliding contact with the flat part 52. However, without being limited to this, the top side of the sheet P where the toner image is formed may be held in sliding contact with the flat part 52 and the underside thereof may be held in sliding contact with the upper surface 51 of the first branching guide member 43.

This application is based on Japanese Patent application serial No. 2009-220287 filed in Japan Patent Office on Sep. 25, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an image forming unit performing a predetermined image forming process to form a toner image on a sheet;

a fixing unit heat-fixing the toner image on the sheet to the sheet; and a sheet discharge unit discharging the sheet finished with the heat-fixing process to the outside, the sheet discharge unit including:

a first path for discharging the sheet finished with the heat-fixing process to the outside, a second path for feeding the sheet again to the image forming unit in the case of performing a duplex image forming process for forming a toner image also on an underside of the sheet opposite to a top side where the toner image is formed;

a sheet conveyor conveying the sheet from the first path to the outside, the sheet conveyor also temporarily discharging to the outside a part of the sheet except for a trailing end of the sheet with respect to a discharge direction of the sheet and then conveying the sheet back to the second path from the discharge direction trailing end; and a corrugating member corrugating the sheet in a width direction of the sheet orthogonal to a conveying direction of the sheet to give the sheet stiffness when the sheet conveyor conveys the sheet;

wherein the second path includes a wall portion defining an upstream path section having a width that extends in a thickness direction of the sheet, the width being set to be narrow to such a degree that the corrugation of the sheet is reduced when the sheet passes the upstream path section, the wall portion having a flat part extending along the upstream path section and having a flat surface contacting a plane of the sheet, a facing member arranged at a position facing the flat part and narrowing the width of the upstream path section, the facing member including an elastic sheet member biased toward the flat part, the elastic sheet member including a base end portion and a leading end portion, the base end portion being positioned at an upstream side with respect to the conveying direction in which the sheet is conveyed to the image forming unit via the second path and being mounted on the facing member, and the leading end portion extending from the base end portion toward a downstream side with respect to the conveying direction and held in contact with the flat part.

2. An image forming apparatus according to claim 1, wherein:

the sheet discharge unit further includes a housing accommodating the first path, the second path, the sheet conveyor and the corrugating member, and the flat part of the wall portion is formed by a part of the housing.

3. An image forming apparatus according to claim 1, wherein the flat part is treated with a surface treatment to improve slidability between the flat part and the sheet.

4. An image forming apparatus according to claim 1, wherein the facing member includes a roller member arranged to face the flat part.

5. An image forming apparatus according to claim 1, wherein the second path includes a downstream path section extending in a curved manner toward the image forming unit.

6. An image forming apparatus, comprising:

an image forming unit performing a predetermined image forming process to form a toner image on a sheet;

a fixing unit heat-fixing the toner image on the sheet to the sheet; and a sheet discharge unit discharging the sheet finished with the heat-fixing process to the outside, the sheet discharge unit including:

a first path for discharging the sheet finished with the heat-fixing process to the outside, a second path for feeding the sheet again to the image forming unit in the case of performing a duplex image forming process for forming a toner image also on an underside of the sheet opposite to a top side where the toner image is formed;

a sheet conveyor conveying the sheet from the first path to the outside, the sheet conveyor also temporarily discharging to the outside a part of the sheet except for a trailing end of the sheet with respect to a discharge direction of the sheet and then conveying the sheet back to the second path from the discharge direction trailing end; and a corrugating member corrugating the sheet in a width direction of the sheet orthogonal to a conveying direction of the sheet to give the sheet stiffness when the sheet conveyor conveys the sheet;

wherein the second path includes a wall portion defining an upstream path section having a width that extends in a thickness direction of the sheet, the width being set to be narrow to such a degree that the corrugation of the sheet is reduced when the sheet passes the upstream path section, the wall portion having a flat part extending along the upstream path section and having a flat surface contacting a plane of the sheet, a facing member arranged at a position facing the flat part and narrowing the width of the upstream path section, the sheet discharge unit further includes a third path that is different from the first path and discharges the sheet finished with the heat-fixing process to the outside, and the facing member is a guide member switching between the first path and the third path.

7. An image forming apparatus according to claim 6, wherein:

the sheet discharge unit further includes an entrance port communicating with the first path and the third path and allowing the sheet to enter the sheet discharge unit from the fixing unit; and the guide member is a rotatable member and includes a projecting portion extending toward the entrance port and an upper surface located at a side opposite to the projecting portion to face the flat part, the guide member switching between the first path and the third path by rotating in a first direction to cause the projecting portion to close the third path and by rotating in a second direction opposite to the first direction to cause the projecting portion to close the first path.

* * * * *